US009345916B1

(12) United States Patent
Kirkbride

(10) Patent No.: US 9,345,916 B1
(45) Date of Patent: May 24, 2016

(54) EMBEDDED, AUTONOMOUS, STAND ALONE FIRE DETECTION AND SUPPRESSION APPARATUS

(71) Applicant: The Boeing Company, Chicago, IL (US)

(72) Inventor: David W. Kirkbride, Allyn, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 14/561,720

(22) Filed: Dec. 5, 2014

(51) Int. Cl.

| | |
|---|---|
| ***A62C 35/00*** | (2006.01) |
| ***A62C 37/10*** | (2006.01) |
| ***A62C 3/08*** | (2006.01) |
| ***A62C 37/44*** | (2006.01) |
| ***A62C 3/00*** | (2006.01) |

(52) U.S. Cl.
CPC . *A62C 3/08* (2013.01); *A62C 3/002* (2013.01); *A62C 37/44* (2013.01)

(58) Field of Classification Search
CPC ..... B64D 5/00; B64D 7/00; B64D 37/00; B64D 45/00; B64D 2045/009; A62C 33/00; A62C 35/58; A62C 35/68; A62C 37/04
USPC ..... 169/16, 56, 46; 239/67, 69
See application file for complete search history.

(56) References Cited

U.S. PATENT DOCUMENTS

| | | | | |
|---|---|---|---|---|
| 5,915,480 | A | 6/1999 | Yemelyanov et al. | |
| 2008/0017393 | A1 * | 1/2008 | Whitney | A62C 35/023 169/60 |
| 2014/0313061 | A1 * | 10/2014 | Gatsonides | G08B 17/00 340/963 |

FOREIGN PATENT DOCUMENTS

| | | |
|---|---|---|
| WO | 2008/053254 | 5/2008 |

* cited by examiner

*Primary Examiner* — Davis Hwu
(74) *Attorney, Agent, or Firm* — Joseph M. Rolnicki; Evans & Dixon, L.L.C.

(57) ABSTRACT

An autonomous, stand alone fire detection and suppression apparatus has a fire suppression pack that is imbedded or positioned at the center of a three-dimensional array stack of boxes and a plurality of radio-frequency identification transponders on each box of the stack of boxes. The transponders are operable to sense an undesirable event, for example a fire in the stack of boxes and communicate with the fire suppression pack at the center of the stack of boxes causing the fire suppression pack to eject a fire suppressant into the stack of boxes surrounding each box, separating adjacent boxes from each other and other stacks of boxes and from the shipping container containing the boxes.

19 Claims, 3 Drawing Sheets

EMBEDDED, AUTONOMOUS, STAND ALONE FIRE DETECTION AND SUPPRESSION APPARATUS

FIELD

This disclosure pertains to an apparatus that detects and then suppresses an undesirable event, for example a fire that occurs in a cargo hold of an aircraft or other means for transporting cargo.

BACKGROUND

The global market for lithium-ion batteries and lithium metal batteries is rapidly expanding. With the expansion of the lithium battery market, the need for air transport of the batteries is also expected to grow.

Lithium batteries are identified as dangerous goods. Air cargo holds are designed to carry multiple kinds and classifications of cargo, from perishable and non-perishable goods to dangerous goods. This requires the aircraft and air crews to have capabilities and systems to respond to an array of different fire types. An acceptable single best approach, methodology or system for dealing with all types of fires has not been identified. To date, no satisfactory method has been identified or accepted by the air transport industry and its worldwide governing bodies to deal with the fire hazards associated with the air transport of lithium metal or lithium ion batteries.

SUMMARY

The autonomous, stand alone fire detection and suppression apparatus of this disclosure and its associated methodologies provide a cost effective means to match the preferred fire fighting response to the cargo being transported.

The apparatus is based around a fire suppression pack. The pack is constructed in a box-like configuration with eight corners. Eight radio-frequency identification (RFID) readers are secured to the exterior of the pack with one RFID reader at each corner.

Eight mixer nozzles are positioned inside the fire suppression pack at the eight corners. Discharge orifices of the nozzles open to the exterior of the pack.

A supply of a fire suppressant is contained in the fire suppressant pack. The supply of fire suppressant communicates with each of the eight nozzles.

A control system module is also contained in the fire suppression pack. The control system module communicates with the eight RFID readers and the supply of fire suppressant. The control system module is operable to control the delivery of fire suppressant from the supply of fire suppressant to each of the eight nozzles. The control system module operates in response to a discharge signal sent by at least one of the eight RFID readers to the control system module. The discharge signal is sent from the RFID reader in response to the RFID reader receiving an activation signal from a separate RFID transponder tag.

In use of the fire suppressant pack, the pack is positioned at the center of a stack of packaging boxes that contain dangerous goods, for example lithium batteries. In one operative environment, twenty six packaging boxes are arranged in a three dimensional array stack around the fire suppression pack. Each of the packaging boxes has RFID transponder tags positioned at the eight corners of the box. Each RFID transponder tag is operable to transmit an activation signal to at least one of the eight RFID readers on the fire suppression pack in response to the RFID transponder tag sensing an undesirable occurrence in the stack of packaging boxes. The undesirable occurrence could be a fire, an explosion, a rapid rise in temperature, a rapid change in pressure, the presence of smoke, the presence of toxic gas, or other similar dangerous conditions.

On receiving an activation signal transmitted by an RFID transponder, the RFID reader sends a discharge signal to the control system module. The control system module then controls the release of fire suppressant from the supply of fire suppressant. The fire suppressant is communicated to each of the eight nozzles on the fire suppressant pack. The nozzles discharge the fire suppressant from the nozzle orifices at the eight corners of the fire suppressant pack.

Gaps are provided between adjacent boxes and between the fire suppressant pack and adjacent boxes in the three-dimensional stack of packaging boxes. The gaps are maintained by spacers positioned between the adjacent boxes and between the fire suppressant pack and the packaging boxes surrounding the pack. The gaps provide flow paths for the fire suppressant released from the fire suppression pack. The flow paths direct the fire suppressant around the fire suppression pack and between the adjacent boxes in the three dimensional stack of boxes.

In this way the fire suppressant pack and the RFID transponder tags detect the fire in the three dimensional stack of packaging boxes and suppress the fire automatically and independently of any other fire suppression system that may exist in the cargo hold.

The features, functions, and advantages that have been discussed can be achieved independently in the various embodiments or may be combined in yet other embodiments, further details of which can be seen with reference to the following description and drawings.

Figure 3:
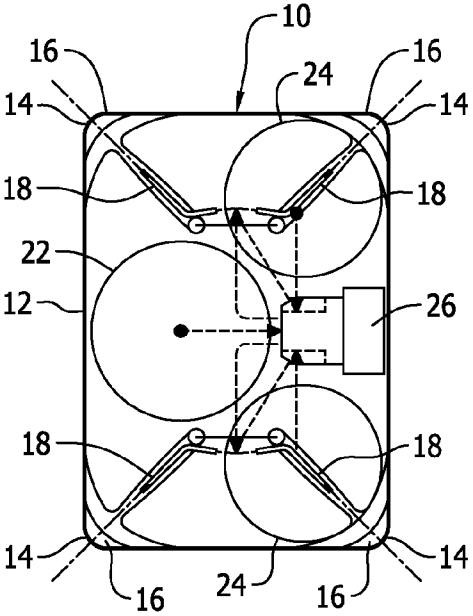
FIG. 3 is a representation of a cross-section through the fire suppression pack along the line 3-3 in FIG. 1.
Figure 1:
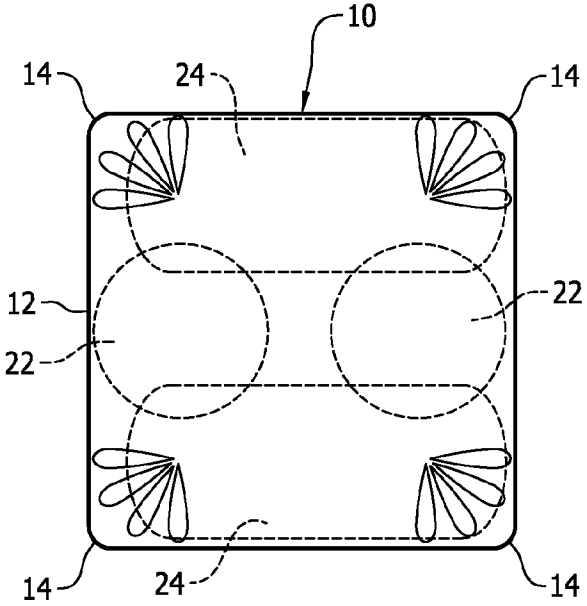
FIG. 1 is a representation of a top plan view of the fire suppression pack, with the bottom view being a mirror image thereof.
Figure 2:
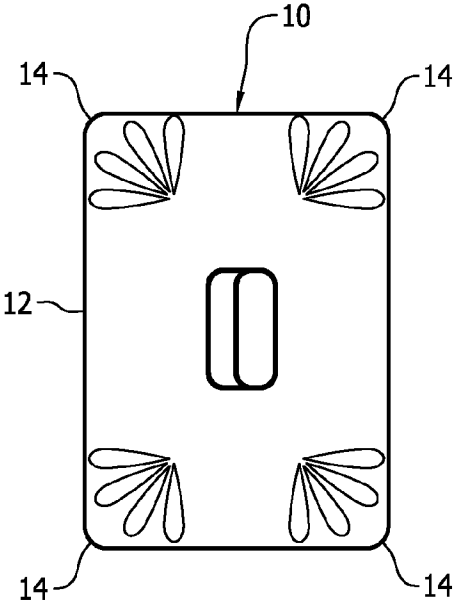
FIG. 2 is a representation of a side view of the fire suppression pack, with the opposite side view being a mirror image thereof.

Each figure shown in this disclosure shows a variation of an aspect of the embodiments presented, and only differences will be discussed in detail.

DESCRIPTION

The autonomous, stand alone fire detection and suppression apparatus is basically comprised of a fire suppression pack, a plurality of radio-frequency identification (RFID) transponders, and air space flow channeling between adjacent cargo packaging boxes as well as air space flow channeling between the stacks of boxes and the cargo containment used for air transport. The RFID transponders and the pack employ near information transfer technology to communicate the transponders with the pack. The apparatus is employed to detect the occurrence and pending occurrence of an undesirable event, for example a fire that occurs in a three-dimensional stacked array of packaging boxes. As will be explained, the fire suppression pack is imbedded or positioned at the center of the three-dimensional array stack of boxes. Each box in the stack of boxes has a plurality of RFID transponders secured to the exterior and/or interior surfaces of the box. Each of the transponders communicates with the fire suppression pack at the center of the stack of boxes.

The imbedded, autonomous, stand alone fire detection and suppression packs are tailored to a specific class and type of dangerous goods being transported. The apparatus has potential use by air, water and land bulk cargo transportation and storage. In the exemplary embodiment of the apparatus used in an aircraft cargo hold, the apparatus does not require airplane provision. There is no parasitic impact on the airplane performance or airplane related costs. The apparatus enables a cargo airplane to carry dangerous goods without incurring design costs, performance decrements and/or operating costs associated with installed airplane fire control systems and/or provisioning for systems and hardware needed for dangerous goods fires but not for perishable or non-perishable goods.

FIGS. 1-4 show representations of the fire suppression pack 10. The fire suppression pack 10 is housed in a container 12 having a box-like or cubic configuration with eight corners 14. The container 12 is dimensioned with basically the same dimensions of the packaging boxes with which the fire suppression pack 10 will be used. This enables the container 12 to fit at the center of the three-dimensional array stack of boxes. The container 12 is constructed of a fire resistant material to protect the contents of the container in the event of a fire in the three-dimensional stack of boxes.

A radio-frequency identification (RFID) reader 16 is provided on each of the eight corners 14 of the container 12. The RFID readers could be at other positions on the container 12 and inside the container. It is also not necessary that there be eight RFID readers. The RFID readers could be active or passive.

Eight mixer nozzles are provided inside the container 12. Each of the mixer nozzles 18 has a discharge orifice 20 that opens at one of the corners 14 of the container 12. The nozzles 18 could be provided at other positions in the container 12. Additionally, there could be fewer than eight nozzles 18.

A supply of fire suppressant is also contained in the container 12 of the fire suppression pack 10. In the example of the pack 10 shown in the drawing figures, two spherical tanks 22 are provided inside the container 12 and two cylindrical tanks 24 are provided inside the container 12. The spherical tanks 22 contain a fire suppressant and the cylindrical tanks 24 contain a propellant. For example, the spherical tanks 22 each contain halon gas under pressure and the two cylindrical tanks 24 contain carbon dioxide ($CO_2$) gas under pressure. Other types of fire suppressants could be employed instead of the halon gas and carbon dioxide gas. For example, the tanks 22, 24 could contain dry chemicals, aerosols, foaming and liquid combustion suppressants, or any mix of suppressant types.

Each of the tanks 22, 24 communicates through valve assemblies (not shown) with the eight discharge nozzles 18.

A control system 26 is contained in the container 12 of the fire suppression pack 10. The control system 26 communicates electronically with each of the eight RFID readers 16 and communicates electronically with the valve assemblies (not shown) that control the delivery of the fire suppressant and propellant from the tanks 22, 24 to the eight nozzles 18. The control system 26 is operable to open the valve assemblies in response to at least one of the RFID readers 16 sending a discharge signal to the control system 26. The RFID reader sends a discharge signal to the control system 26 in response to the RFID reader 16 receiving an activation signal from a separate RFID transponder tag.

Figure 4:
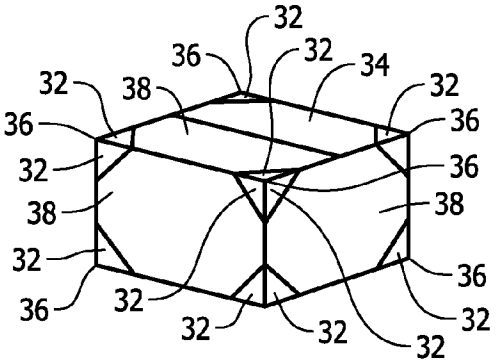
FIG. 4 is a representation of a perspective view of one of the packaging boxes.

As stated earlier, the autonomous, stand alone fire detection and suppression apparatus is also comprised of a plurality of radio-frequency identification (RFID) transponders 32. As represented in FIG. 4, each packaging box 34 with which the fire suppression pack 10 is used has a box-like or cubic configuration with a RFID transponder 32 applied at each of the four corners 36 on each of the six rectangular surfaces 38 of the box. Thus, each box 34 has 24 RFID transponders 32 secured to the exterior surface of the box. Other numbers of transponders 32 could be attached to each box 34, and the transponders 32 could be positioned at other positions on each box other than the corners 36. The transponders 32 could be active or passive. Each of the transponders 32 is designed to transmit an activation signal to one of the RFID readers 16 of the fire suppression pack 10 in response to the transponder sensing an undesirable occurrence, for example a fire, explosion, a rapid rise in temperature, a rapid change in pressure, the presence of smoke, the presence of toxic gas, an acoustic footprint, or other similar markers indicating a dangerous condition.

Figure 6:
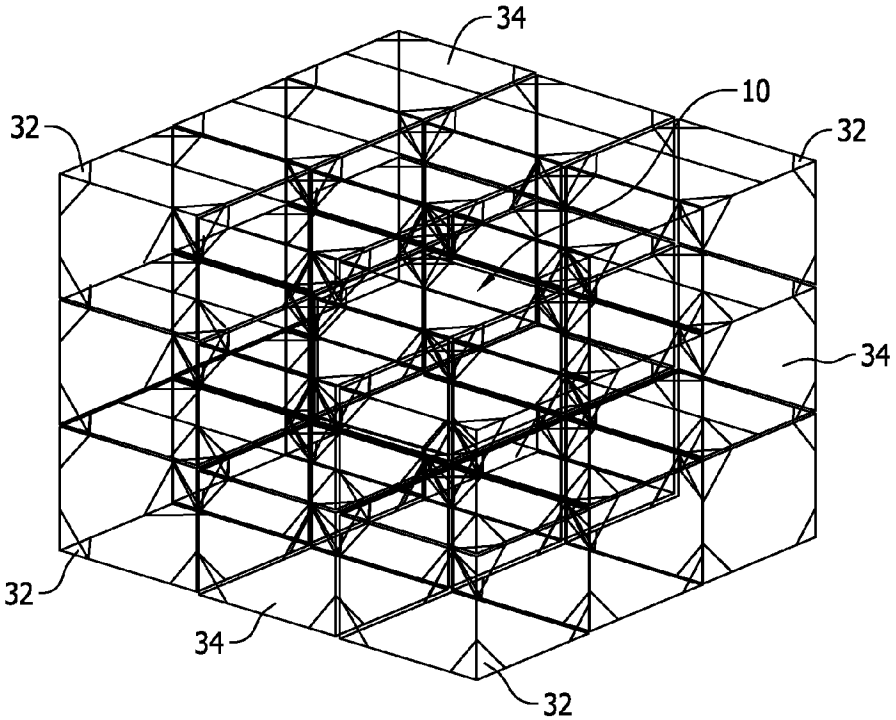
FIG. 6 is a representation of a three dimensional stack of packaging boxes surrounding the fire suppression pack.

FIG. 6 is a representation of a use of the fire suppression pack 10. As represented in FIG. 6, the fire suppression pack 10 is positioned at the center of a three-dimensional array stack of packaging boxes 34 that contain dangerous goods, for example lithium-ion batteries. In an alternative use, the packaging boxes 34 could be arranged in a two-dimensional array around the fire suppression pack 10. In the example shown in FIG. 6, twenty six packaging boxes 34 are arranged in the three-dimensional array stack around the fire suppression pack 10. As described earlier, each of the packaging boxes 34 has three RFID transponder tags 32 positioned at each of the eight corners of each box. Each RFID transponder tag 32 is operable to transmit an activation signal to at least one of the eight RFID readers 16 on the fire suppression pack 10 in response to the RFID transponder tag 32 sensing an undesirable or near undesirable occurrence in the stack of packaging boxes.

Figure 5:
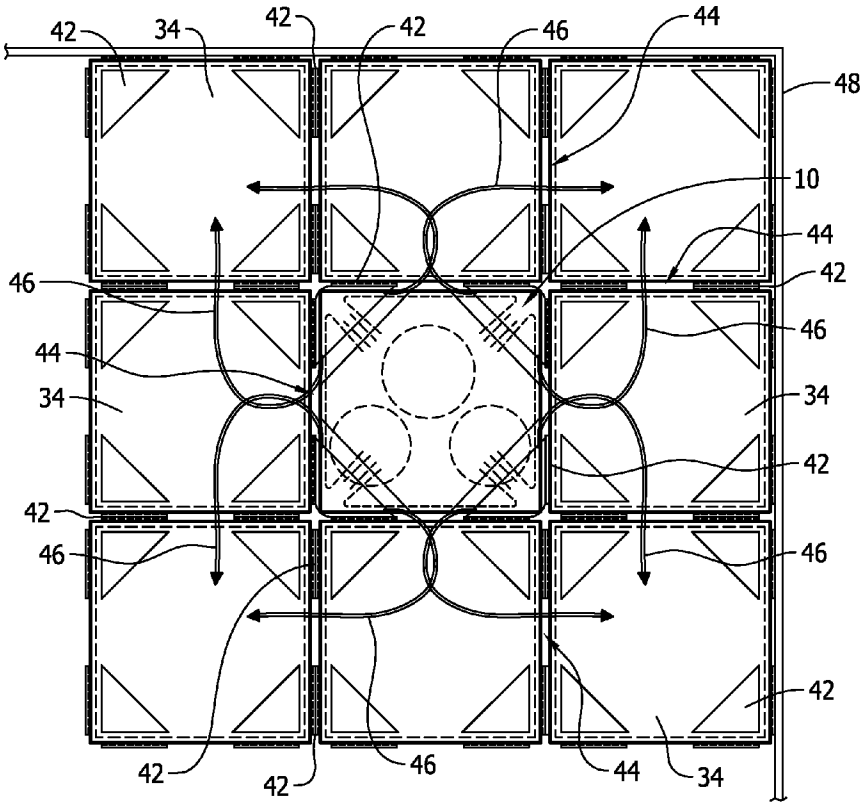
FIG. 5 is a representation of a cross-section through a three dimensional stack of packaging boxes and the fire suppression pack.

FIG. 5 is a representation of a cross-section view through the three-dimensional array of stacked packaging boxes 34 of FIG. 6. As the packaging boxes 34 are assembled in the stack, thin pad-up spacers 42, for example cardboard spacers are positioned between adjacent packaging boxes 34 (or may be an integral part of the construction of the packaging boxes 34) in the stack and between the fire suppression pack 10 and the adjacent packaging boxes 34. As represented in FIG. 5, each of the pad-up spacers 42 has a general triangular configuration and is positioned at the four corners of each of the side surfaces of the packaging boxes 34. The pad-up spacers 42 create flow path gaps 44 between the adjacent packaging boxes 34, between the fire suppression pack 10 and the surrounding packaging boxes 34, and between the shipping container or the cover 48 of the pallet used to ship the stacks of packaging boxes 34. The gaps 44 create flow paths around the packaging boxes 34, and between the packaging boxes 34 and the shipping container or a covered cargo container 48 of the pallet used to ship the packaging boxes 34 as represented by the arrows 46 in FIG. 5. These flow paths 46 enable fire suppressant ejected from the fire suppressant pack 10 to quickly flow through the three-dimensional array of the stacked packaging boxes 34.

In operation of the fire suppressant pack 10, when one of the RFID transponders 32 senses an undesirable or pending undesirable occurrence, for example a fire, in one of the packaging boxes 34 of the three-dimensional array stack of boxes, the RFID transponder 32 transmits an activation signal through the three-dimensional array of packaging boxes 34. The activation signal is received by at least one of the RFID readers 16 of the fire suppression pack 10. On receipt of the activation signal by the RFID reader 16, the RFID reader 16 transmits a discharge signal to the control system module 26 in the fire suppression pack 10. When the discharge signal is received by the control system module 26, the control system module 26 then controls the opening of the valves on the fire suppressant tanks 22 and propellant tanks 24, causing the fire suppressant and propellant to be mixed in and released from the eight nozzles 18 at the corners of the fire suppression pack container 12. The eight nozzles 18 discharge the fire suppressant and propellant from the nozzle orifices at the eight corners of the fire suppressant pack container 12. The discharged fire suppressant and propellant quickly fills the flow paths 46 defined by the gaps 44 between the adjacent packaging boxes 34, between the fire suppressant pack 10 and surrounding packaging boxes 34, and between the packaging boxes 34 and the shipping container or the cover 48 of the pallet used to ship the packaging boxes 34.

In the above-described manner, the fire suppressant pack 10 and the RFID transponder tags 32 detect the fire and conditions leading up to the fire, during the fire and after the fire in the three-dimensional array stack of packaging boxes 34 and suppress the fire automatically and independently of any other fire suppression system that may exist in the cargo hold.

As various modifications could be made in the construction of the apparatus and its method of operation herein described and illustrated without departing from the scope of the invention, it is intended that all matter contained in the foregoing description or shown in the accompanying drawings shall be interpreted as illustrative rather than limiting. Thus, the breadth and scope of the present disclosure should not be limited by any of the above described exemplary embodiments, but should be defined only in accordance with the following claims appended hereto and their equivalents.

The invention claimed is:

1. An autonomous, stand alone fire detection and suppression apparatus comprising:

a fire suppression pack, the fire suppression pack being housed in a container constructed of fire resistant material, a RFID reader on the container of the fire suppression pack, a nozzle inside the container, a supply of fire suppressant inside the container, the supply of fire suppressant communicating with the nozzle and a control system module inside the container, the control system module communicating with the RFID reader and the supply of fire suppressant, the control system module being operable to control delivery of fire suppressant from the supply of fire suppressant to the nozzle in response to the RFID reader receiving an activation signal from a RFID transponder; and, a plurality of like packaging boxes arranged in a two-dimensional array around the container of the fire suppression pack, each packaging box of the plurality of like packaging boxes having a RFID transponder, the RFID transponder being operable to transmit an activation signal to the RFID reader in response to the RFID transponder sensing an undesirable occurrence adjacent the RFID transponder.

2. The apparatus of claim 1, further comprising:

gaps between the plurality of like packaging boxes and the fire suppression pack.

3. The apparatus of claim 1, further comprising:

the plurality of like packaging boxes are arranged in a three dimensional array around the fire suppression pack.

4. The apparatus of claim 3, further comprising:

gaps between the plurality of like packaging boxes and the fire suppression pack.

5. The apparatus of claim 1, further comprising:

the nozzle being one of a plurality of nozzles inside the container of the fire suppression pack.

6. The apparatus of claim 5, further comprising:

the container of the fire suppression pack having a cubic configuration with eight corners; and, a nozzle of the plurality of nozzles being positioned at each of the eight corners.

7. The apparatus of claim 1, further comprising:

the RFID reader being one of a plurality of RFID readers inside the container of the fire suppression pack.

8. The apparatus of claim 7, further comprising:

the container of the fire suppression pack having a cubic configuration with eight corners; and, a RFID reader of the plurality of RFID readers being positioned at each of the eight corners.

9. The apparatus of claim 1, further comprising:

the RFID transponder of each packaging box of the plurality of like packaging boxes being one of a plurality of RFID transponders on each packaging box.

10. The apparatus of claim 9, further comprising:

each packaging box having a cubic configuration with eight corners; and, a RFID transponder of the plurality of RFID transponders being positioned at each of the eight corners.

11. The apparatus of claim 9, further comprising:

each packaging box having a cubic configuration with six rectangular surfaces, each rectangular surface having four corners; and, a RFID transponder of the plurality of RFID transponders positioned at each corner of the six rectangular surfaces.

12. An autonomous, stand alone fire detection and suppression apparatus comprising:

a fire suppression pack, the fire suppression pack being housed in a container constructed of fire resistant material, the container having a cubic configuration with eight corners, the container of the fire suppression pack having eight RFID readers positioned at the eight corners, the container of the fire suppression pack containing eight mixer nozzles positioned at the eight corners and communicating with an exterior of the container of the fire suppression pack, the container of the fire suppression pack containing a supply of a fire suppressant under pressure and in communication with the eight nozzles, and the container of the fire suppression pack containing a control system module communicating with the eight RFID readers and the supply of fire suppressant, the control system module being operable to control delivery of fire suppressant from the supply of fire suppressant to the eight nozzles in response to a discharge signal sent by at least one of the eight RFID readers to the control system module in response to the at least one of the eight RFID readers receiving an activation signal from a RFID transponder; and, a plurality of packaging boxes arranged in a three dimensional array stack around the container of the fire suppression pack, each packaging box having eight corners and a RFID transponder at each of the eight corners, each RFID transponder being operable to transmit an activation signal to at least one of the eight RFID readers in response to the RFID transponder sensing an undesirable occurrence in the three dimensional array stack.

13. The apparatus of claim 12, further comprising:

there being a gap between adjacent packaging boxes of the plurality of packaging boxes and there being gaps between the container of the fire suppression pack and adjacent packaging boxes of the plurality of packaging boxes.

14. The apparatus of claim 13, further comprising:

a plurality of spacers positioned to create gaps between adjacent packaging boxes and between the container of the fire suppression pack and adjacent packaging boxes and surrounding cargo containments.

15. A method of detecting and suppressing fire in a stack of packaging boxes, the method comprising:

providing a fire suppression pack housed in a container constructed of a fire resistant material and positioning the container in the stack of packaging boxes, the container of the fire suppression pack having a RFID reader on the container, a nozzle inside the container that communicates with an exterior of the container of the fire suppression pack, a supply of fire suppressant inside the container of the fire suppressant pack that communicates with the nozzle, and a control system module inside the container of the fire suppression pack that communicates with the RFID reader and the supply of fire suppressant where the control system module is operable to control delivery of fire suppressant from the supply of fire suppressant to the nozzle to eject the fire suppressant from the nozzle in response to the RFID reader receiving an activation signal from a RFID transponder and the RFID reader delivering a discharge signal to the control system module; and, arranging the stack of packaging boxes in a two-dimensional array around the container of the fire suppression pack and providing a RFID transponder on each of the packaging boxes where each RFID transponder is operable to transmit an activation signal to the RFID reader of the fire suppression pack in response to the RFID transponder sensing an undesirable occurrence in the stack of packaging boxes.

16. The method of claim 15, further comprising:

arranging the stack of packaging boxes in a three dimensional array around the container of the fire suppression pack.

17. The method of claim 16, further comprising:

arranging the stack of packaging boxes with gaps between adjacent packaging boxes and between the container of the fire suppression pack and adjacent packaging boxes.

18. The method of claim 16, further comprising:

arranging the stack of packaging boxes in a covered cargo container.

19. The method of claim 18, further comprising:

arranging the stack of packaging boxes with gaps between adjacent packaging boxes and between packaging boxes and a cover of the covered cargo container.

* * * * *